United States Patent [19]

O'Brien

[11] 4,073,075

[45] Feb. 14, 1978

[54] GOLF TRAINING DEVICE

[76] Inventor: John P. O'Brien, 175 E. Delaware Place, Chicago, Ill. 60611

[21] Appl. No.: 753,927

[22] Filed: Dec. 23, 1976

Related U.S. Application Data

[63] Continuation-in-part of Ser. No. 683,898, May 6, 1976, abandoned.

[51] Int. Cl.[2] ..... A63B 69/36; A43B 5/00

[52] U.S. Cl. ..... 36/127; 273/187 B; 36/136; 273/32 C

[58] Field of Search ..... 273/188 R, 188 A, 35 R, 273/187 B, 183 B, 32 C, 187 R, 187 A; 36/127, 136

[56] References Cited

U.S. PATENT DOCUMENTS

| | | | |
|---|---|---|---|
| 3,218,734 | 11/1965 | O'Brien | 273/187 B X |
| 3,840,229 | 10/1974 | Phillips | 36/127 X |
| 3,951,407 | 4/1976 | Calacurcio | 273/188 A X |

*Primary Examiner*—George J. Marlo

*Attorney, Agent, or Firm*—Cook, Wetzel & Egan, Ltd.

[57] ABSTRACT

A gold training device wherein a wedge-shaped member is provided with one or more pins mounted on an upward extension thereof. The pins are adapted to fit into holes provided in the sole of a golfer's shoe for the purpose of attaching the device to the shoe. The golf training device is adapted to be secured to conventional golf shoes, street shoes, and sport shoes which are adapted to receive the sole-engaging pins.

8 Claims, 5 Drawing Figures

GOLF TRAINING DEVICE

This is a continuation-in-part application of my copending application Ser. No. 683,898 filed May 6, 1976, now abandoned.

The present invention relates to a golf training device, more particularly a wedge-shaped golf training device which may be removeably affixed to the sole of a shoe, thus enabling a golfer to practice his golf swing using the training device, but to readily remove the training device from the shoe when desired. The golf training device of the present invention may be affixed to specially constructed shoes or may be affixed to conventional shoes which are appropriately modified, as is more fully described below.

It is well known that many individuals could play an improved game of golf if they could develop a proper and consistent golf swing. Various books and articles on golf have been written wherein the proper form and style of golf swing is described. However, simply reading a book or article on how to swing a golf club and hit a golf ball does not inherently provide a golfer with the feel of a proper and consistent swing, nor does it provide him with a proper and consistent swing.

One of the major shortcomings in the swing of many golfers, and particularly among the high handicap golfers, is a tendency to sway "off the ball," i.e., away from the intended target, during the backswing, coupled with a failure to sway back to the point at which the swing was started, during the downswing. This fundamental error causes the golfer to have most of his weight on his rear foot and to swing from his rear foot, when the club head is brought back to the ball, which, in turn, frequently results in a slice, a topped shot, a smothered duckhook or other types of mis-hit golf shots which will be known to those having the ordinary skill in the art.

It has been recognized by golfers, and particularly golf teachers or golf teaching professionals that the tendency to sway "off the ball," away from the intended target, can be reduced if a golfer's rearward foot (the foot furthest from the intended target) is canted or tilted toward the target. The canting of the rear foot tends to keep the golfer's weight equally distributed between the rear foot and the front foot and serves as a reminder to the golfer to avoid swaying "off the ball" during the backswing.

It is theorized that canting the rear foot toward the target will allow a golfer to transfer as much as 60 or 70% of his weight to the inside edge of his rear foot, but at the same time a substantial portion of the golfer's weight will remain on the front foot throughout the entire swing including the top of the backswing. Canting the rear foot toward the target will tend to force the golfer to keep his weight on the inside edge of his foot and thus reduce the chances that the golfer will transfer all of his weight to the rear foot. When the golfer's weight is thus distributed at the top of his backswing, i.e., no more than about 70% of his weight on the rear foot, he is able to shift his weight to the front foot during the downswing, at the same time maintain a steady head position "over the ball."

Many devices have been devised by the prior art in order to accomplish the canting of the rear foot toward the target. Some golf teaching professionals simply suggested that their pupils place a golf ball under the outside edge of the rear foot. While such an expedient can be used, every time the golfer wishes to reposition his rear foot, it is necessary to reposition the golf ball under his shoe.

The prior art has suggested the use of golf shoes wherein one or both of the shoes are canted inwardly. In particular, U.S. Pat. No. 3,789,523 suggests that the rear foot be equipped with a shoe which is canted toward the target. However, this patent describes a shoe which is permanently raised along its outer edge. While this might achieve some of the objectives of the present invention, insofar as giving the golfer the feel of the correct golf swing, such shoes are not adapted to be used as an ordinary street shoe or as ordinary golf shoes. Further, walking substantial distances with one shoe canted would probably be uncomfortable and might cause various orthopedic problems.

Applicant's U.S. Pat. No. 3,218,734 described a removable supporting attachment for golf shoes, wherein the removable support is adapted to be affixed to a specifically designed spike or cleat in a golf shoe, which is inserted in the golf shoe for the purpose of holding the support attachment. While this device was successful in giving a golfer the correct feel of a proper swing, and had the advantage of being removable, the means for attaching the supporting device required the use of a special spike or cleat which had certain inherent limitations.

Applicant's copending application Ser. No. 661,779 filed Feb. 24, 1976, describes a golf training device adapted to be removably affixed to a golf shoe, wherein an annular magnet holds the training device to the flange of a standard golf spike which is mounted on a golf shoe. While the device described and claimed in the copending application has many desirable attributes, it is not adapted to be used on shoes other than golf shoes which are fitted with conventional spikes.

A great deal of golf practice is conducted at driving ranges which are open to the public. Many of the customers at such driving ranges are not equipped with golf shoes, but are wearing street shoes or sport shoes of various configurations which are not equipped with golf spikes. The training device of the present invention is designed to be used by such driving range patrons, who are not wearing golf shoes. The training device of the present invention is designed to fit certain conventional street shoes or sport shoes which are constructed (or modified) in order to receive the golf training device of the present invention. Such shoes, whether originally constructed in the fashion described below or modified as described below, can be used to removably secure the golf training device to the shoe on the rear foot of the golfer, whereby the golf training device may be attached to the shoe for practice purposes, but later removed to convert the shoe into what essentially is a street shoe. The present invention further contemplates that the golf training device of the present invention may be used with golf shoes which are suitably produced or modified to receive the training device of the present invention.

The present invention is directed to a wedge-shaped support device which is removably attached to suitably modified or produced shoes, which enable the training device to be removably affixed to the shoe, preferably under the arch of the foot, in order to cant the desired foot in the desired direction. The advantages of the present invention will become apparent from the following specification and claims, and from the accompanying drawing in which:

Figure 1:
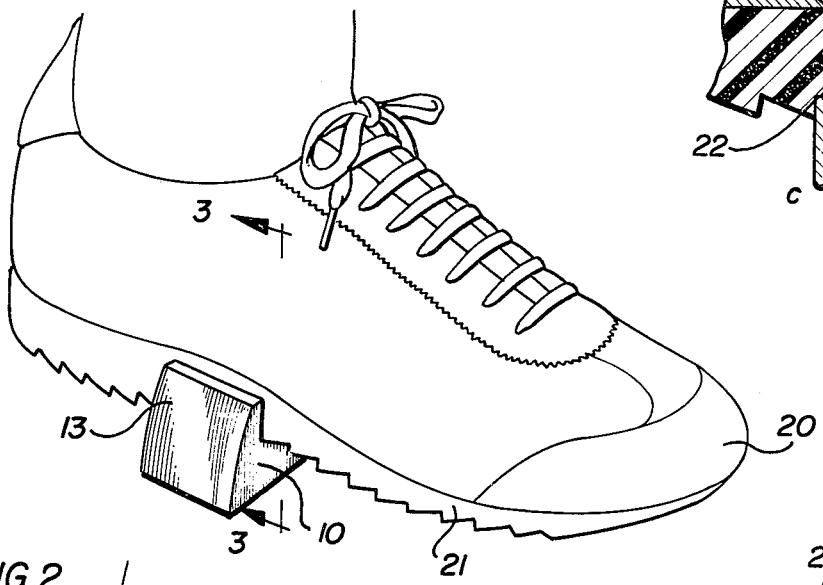
FIG. 1 is an isometric view of the wedge-shaped golf training device of the present invention affixed to a sport shoe for the right foot, as it would be used in practice.

The wedge-shaped golf training device of the present invention, as it would be used by righthanded golfers, is shown affixed to the shoe for the right foot in FIG. 1. The training device as shown is placed on the outside edge of the right foot, thus inwardly canting the right foot of the righthanded golfer toward the target which lies ahead and to the golfer's left side. When in place, as is shown in FIG. 1, the training device tends to cause the golfer to weight the inside edge of his right foot. Thus when the training device is in place, any weight shifted to the right foot will tend to remain on the inside of the foot, thus minimizing the chances that the golfer will sway to the rear, "off the ball," and away from the target during the backswing.

Figure 2:
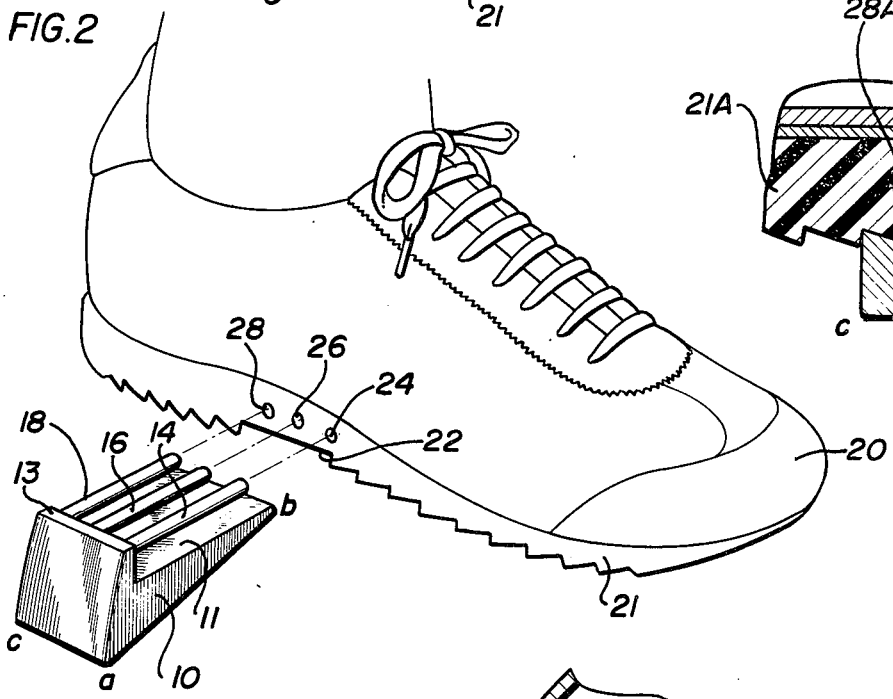
FIG. 2 is an isometric view of the wedge-shaped golf training device of the present invention removed from the shoe, wherein the training device is aligned in a position for insertion.

The preferred embodiment of the golf training device of the present invention, which is shown in FIG. 2 in the removed position, includes a wedge-shaped body 10 which serves as the main supporting member for the shoe to be canted, shown generally at 20. Upper support surface 11 of wedge-shaped body 10 is adapted to cooperate with the sole 21 of the shoe 20 as is more fully explained below. The lower, ground engaging surface 12 of wedge-shaped body 10 is preferably planar, although it may be knurled or otherwise fashioned to produce an increased frictional engagement, thus reducing the possibility of slippage. Wedge-shaped body 10 includes upper extension 13 to which one or more sole-engaging pins are affixed in a plane approximately parallel to upper support surface 11 and preferably at approximate right angles to upper extension 13. In the preferred embodiment, as shown in FIG. 2, the device comprises a plurality of sole-engaging pins, shown as pins 14, 16 and 18. In the event a plurality of pins are employed, it is essential that they be parallel to each other and preferably are parallel to upper support surface 11.

Figure 3:
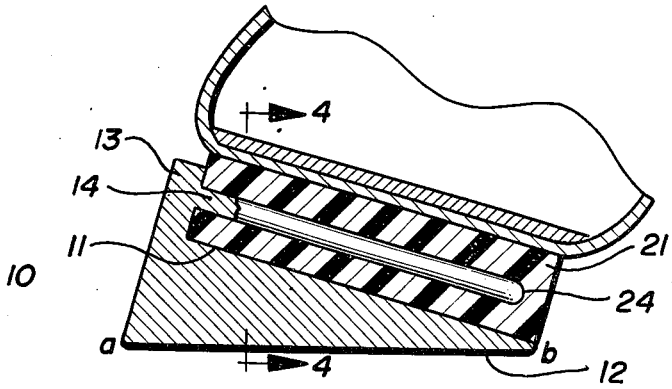
FIG. 3 is a front view of the wedge-shaped golf training device affixed to the shoe, taken in section 3—3 of FIG. 1.

Preferably wedge-shaped body 10 has a length, i.e., taken from point *a* to point *b*, approximately the width of the shoe to be supported, as is shown in FIG. 3. Upper support surface 11 extends contiguously from the narrow edge of the wedge-shaped member 10 to the upper extension 13, where support surface 11 meets the inside surface of upper extension 13 at right angles, and thus preferably support surface 11 extends across the width of the shoe. The width of the wedge-shaped member 10, taken from point *a* to point *c*, is not critical so long as adequate mounting devices can be employed so as to get secure attachment to the shoe sole. It is preferred that the width of the training device be from about 1 to 2 inches, although wider or narrower devices are useful. Relatively wide wedges are preferred in those embodiments which include only a single sole-engaging pin.

As can be seen from FIG. 2, shoe 20 is fitted with sole 21, which in turn includes a mounting surface 22 which is complementary to support surface 11. The sole 21 also includes holes 24, 26 and 28 which are parallel to one another, and preferably are parallel to mounting surface 22. The holes 24, 26 and 28 are preferably large enough to accommodate pins 14, 16 and 18 and thus permit the wedge-shaped device to be engaged with shoe 20 as is shown in FIG. 1, by sliding the pins 14, 16 and 18 into holes 24, 26 and 28 until upper extension 13 abutts sole 21. FIG. 3 depicts the wedge-shaped device 10 in position on the shoe, and shows pin 14 engaged in hole 24.

Figure 4:
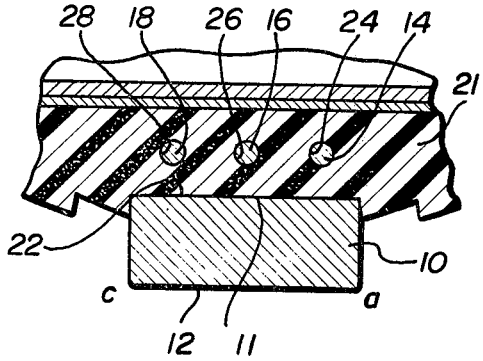
FIG. 4 is a side view showing the preferred embodiment of the wedge-shaped training device in place on the golf shoe, taken in section 4—4 of FIG. 3.

As can be seen from FIG. 4, mounting surface 22 of the sole 21 is fashioned to be complementary to the support surface 11 of the wedge-shaped device. This may be accomplished by suitable shaping of either the shoe sole 21 or the upper support surface 11, but is most conveniently accomplished when both surfaces are planar. In this manner the shoe is firmly supported across its width by the wedge-shaped device.

The upper extension 13 limits the movement of the pins into the holes of the sole, as is shown in FIG. 3. The pins in the holes should be coordinated with respect to size so that the wedge device will stay securely in place during use, but can be removed without too great an effort.

Figure 5:
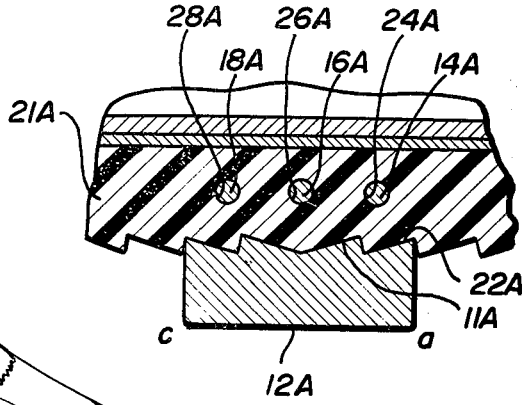
FIG. 5 is a side view of a modified wedge-shaped training device, in place on a shoe, taken in section similar to line 4—4 of FIG. 3.

FIG. 5 depicts another embodiment of the present invention, wherein non-planar support surface 11A is designed to complement the lower surface of the shoe sole 22A, which is also non-planar, in order to produce a mated complementary surface. This particular style of wedge-shaped training device may be particularly useful where a shoe manufacturer does not wish to alter the configuration of the soles. In such a case, the existing shoe can be manufactured simply by drilling holes of appropriate spacing and dimensions, parallel to the lower surface of said sole at locations 24A, 26A and 28A, as is shown in FIG. 5.

The sole-engaging pins 14, 16 and 18 are shown in FIGS. 2 and 3 as extending substantially across the length of the wedge device, but obviously they may be longer or shorter in order to satisfy particular conditions. As was mentioned above, the golf training device of the present invention may be fashioned with one or more sole-engaging pins, which pins may vary in length, size, and spacing. While the drawings illustrate pins of circular cross-section, various cross-sectional shapes, such as squares or triangles, also may be employed. The wedge-shaped device of the present invention is shown with approximately a 15° angle of cant, although the invention is not necessarily limited thereto. It will be obvious to those skilled in the art that wedges having a greater or lesser degree of canting may be employed for various purposes.

As was mentioned above, the present invention contemplates that street shoes or even golf shoes, in addition to the sport style shoe depicted in the drawings, may be fitted with the golf training device described herein. The shoes may be either manufactured to include the adaptations necessary to engage the golf training device, or the shoe may be modified after construction to receive the golf training device.

It is preferred to install the golf training device under the arch portion of the shoe, as is shown in the drawings. However, in those cases where the sole portion of the shoe is too thin to receive the mounting pins 14, 16 and 18, the holes may be drilled near the heel portion of the shoe or may be drilled on the ball of the foot.

The wedge-shaped device of the present invention may be constructed of any desired material of construction including metal, plastic, wood, or combinations thereof. The forms of invention herein shown and described are to be considered only as illustrative. It will be apparent to those skilled in the art that numerous modifications may be made therein without departure from the spirit of the invention or the scope of the appended claims.

I claim:

1. A wedge-shaped golf training device adapted to be removably affixed to a shoe, said training device comprising a wedge-shaped body, having a lower, ground engaging surface, and an upper support surface adapted to complement the lower surface of a shoe to be supported, said wedge-shaped body including an upper extension at its thickest end, at least one sole-engaging pin mounted on said upper extension, said sole-engaging pin being mounted approximately parallel to the plane of said support surface and at approximate right angles to said upper extension.

2. A wedge-shaped golf training device as described in claim 1, which includes a plurality of sole-engaging pins mounted parallel to one another.

3. A wedge-shaped golf training device as described in claim 2, wherein said support surface is essentially planar.

4. A wedge-shaped golf training device as described in claim 1, which includes three mounting pins.

5. A golf training device comprising a shoe and a wedge-shaped golf training device adapted to be removably affixed to a shoe, said training device comprising a wedge-shaped body, having a lower, ground engaging surface, and an upper support surface adapted to complement the lower surface of a shoe to be supported, said wedge-shaped body including an upper extension at its thickest end, at least one sole-engaging pin mounted on said upper extension, said sole-engaging pin being mounted approximately parallel to the plane of said support surface and at approximate right angles to said upper extension, said shoe comprising a sole with openings adapted to receive sole-engaging pins.

6. A golf training device as described in claim 5, which includes a plurality of sole-engaging pins mounted parallel to one another.

7. A golf training device as described in claim 6, wherein said support surface is planar.

8. A golf training device as described in claim 6, wherein the openings in said sole are located under the arch of said shoe.

* * * * *